United States Patent [19]

Ruckert

[11] Patent Number: 5,018,614

[45] Date of Patent: May 28, 1991

[54] TICKET VENDING MACHINE

[75] Inventor: Wolf-Dietrich K. Ruckert, Vienna, Austria

[73] Assignee: Theodor Braun, Ges, m.b.H, Vienna, Austria

[21] Appl. No.: 461,612

[22] Filed: Jan. 8, 1990

[51] Int. Cl.[5] ..... G07F 5/04; G07F 11/26

[52] U.S. Cl. ..... 194/236; 194/256; 221/230; 221/248; 221/259

[58] Field of Search ..... 221/228, 230, 248, 259; 194/254, 256, 236

[56] References Cited

U.S. PATENT DOCUMENTS

| | | | |
|---|---|---|---|
| 545,338 | 8/1895 | Bowie | 221/248 X |
| 1,889,689 | 11/1932 | Millis | 221/248 X |
| 2,996,219 | 8/1961 | Tsai | 221/259 |
| 3,126,122 | 3/1964 | Sacre | 221/259 X |
| 3,790,161 | 2/1974 | Ericsson | 221/188 X |
| 4,316,553 | 2/1982 | Persson | 221/182 X |

*Primary Examiner*—F. J. Bartuska
*Attorney, Agent, or Firm*—Herbert W. Larson

[57] ABSTRACT

An outer housing encloses an inner panel separating a money accepting and ticket dispensing apparatus. The money accepting apparatus releases an internal lever upon insertion of the correct money. This internal lever disengages from a toothed plate which is connected by a shaft to an external hand lever. A pulling of the external hand lever after insertion of the correct money turns multiple gears which cause a cam to actuate to release a ticket retaining gate. In addition, the gears are connected to a cylindrical rear roller which turns a pair of latex bands mounted around the rear roller and a front cylindrical roller mounted on an idler shaft. A weight over the tickets causes frictional pressure to be exerted on the ticket by turning bands and thereby allows the bands to move a single ticket under a raised exit gate.

15 Claims, 6 Drawing Sheets

TICKET VENDING MACHINE

BACKGROUND OF THE INVENTION

1. Field of the Invention

This invention relates to vending machines. More particularly, it refers to a lottery ticket vending machine delivering a ticket upon insertion of money into the machine.

2. Description of the Prior Art

An apparatus for dispensing tickets from a weighted stack mounted within the apparatus is known from by U.S. Pat. No. 3,790,161. Another type of ticket vending machine is described in U.S. Pat. No. 4,316,553 and a mechanism for dispensing sheets of paper is shown in U.S. Pat. No. 3,126,122.

Many prior art ticket dispensing machines have caused problems in the dispensing of new rub-off type lottery tickets. In many cases, the lottery ticket is damaged by the dispensing mechanism. In addition, jamming of tickets during dispensing is caused by the substitution of different thickness tickets without means for adjusting the machine. In addition, more than one ticket is sometimes dispensed from a single actuation of the machine. A lottery ticket dispensing machine is needed which will deliver rub-off lottery tickets undamaged, will be adjustable for different thickness tickets, will operate free of jamming and will only dispense a single ticket from a single actuation.

SUMMARY OF THE INVENTION

I have invented an improved lottery ticket dispensing apparatus in which lottery tickets are delivered to the customer undamaged and the apparatus can be easily adjusted for different thickness tickets. In addition, the apparatus is free from jamming problems and consistently delivers a single ticket in response to a single actuation of the machine by inserting money.

My ticket dispensing machine has an outer housing enclosing a money accepting and ticket dispensing apparatus, each apparatus separated by an internal panel. A lever for actuating the ticket dispensing apparatus is connected to a shaft penetrating a side panel of the outer housing. The outer housing has a first slot for inserting money and a second slot for dispensing a ticket.

The shaft attached to the lever is connected by a shear pin to an internal shaft at its first end. The second end of the internal shaft is connected to a toothed plate. A single forward movement of the lever causes the toothed plate to move forward while engaging an intermediate drive gear. The intermediate drive gear turns another drive gear having a rotating shaft driving a rear cylindrical member around which a rough surfaced latex fabric material is wound. A front cylindrical member mounted on an idler shaft also supports the fabric material.

The tickets are stacked in a ticket housing with a weighted member pressing them down towards the latex fabric. A gate allows one ticket at a time to exit the stack upon frictional engagement with the latex fabric.

A double stop mechanism prevents issuance of more than one ticket after insertion of either a coin or paper money.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
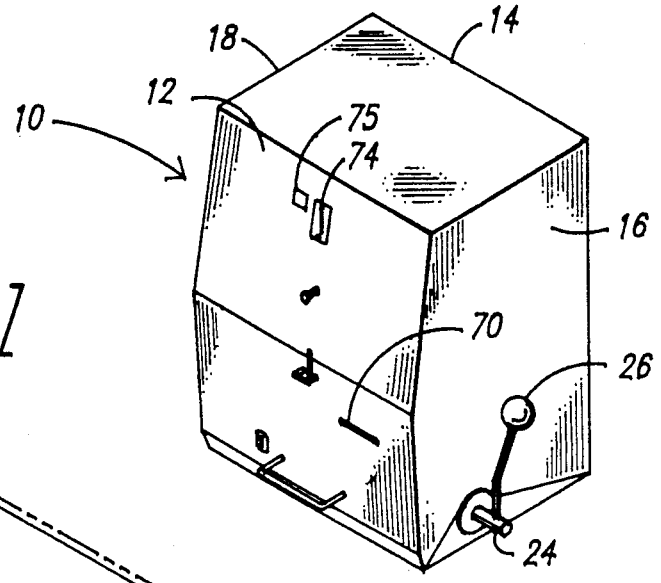
FIG. 1 is a perspective view of the outer housing of the lottery ticket dispensing machine.
Figure 2:
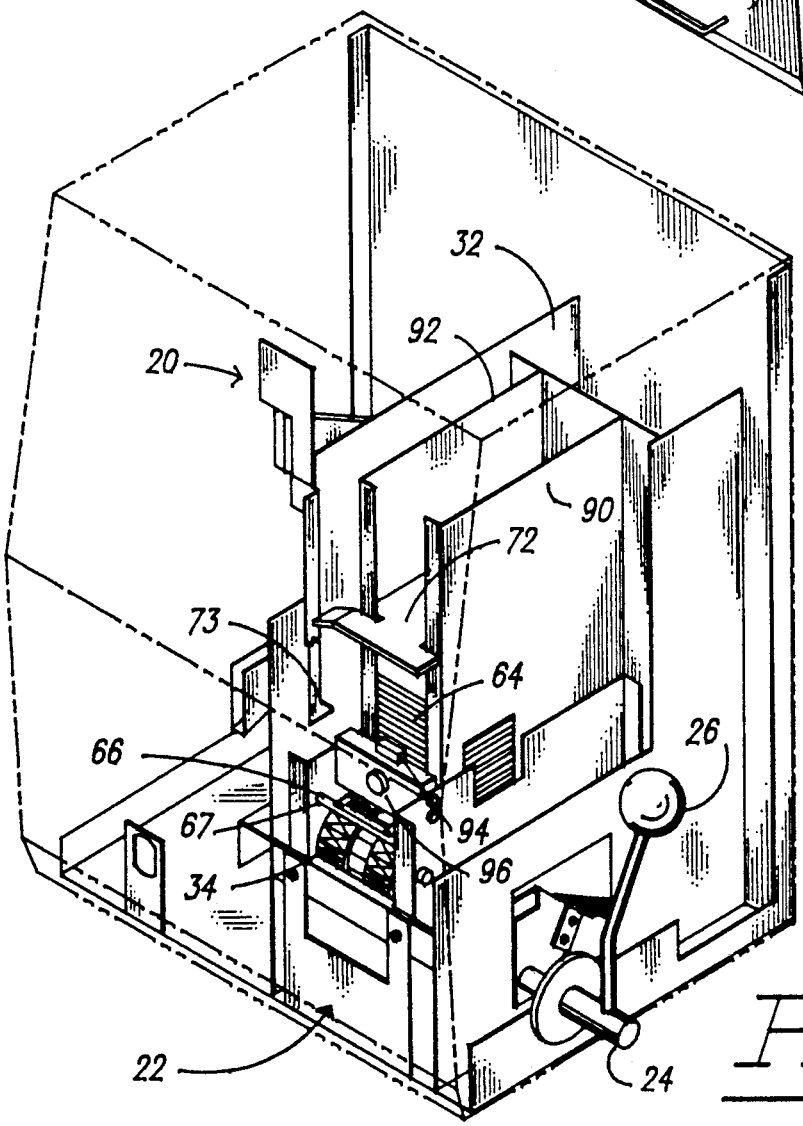
FIG. 2 is a cut away view of the ticket dispensing apparatus.
Figure 3:
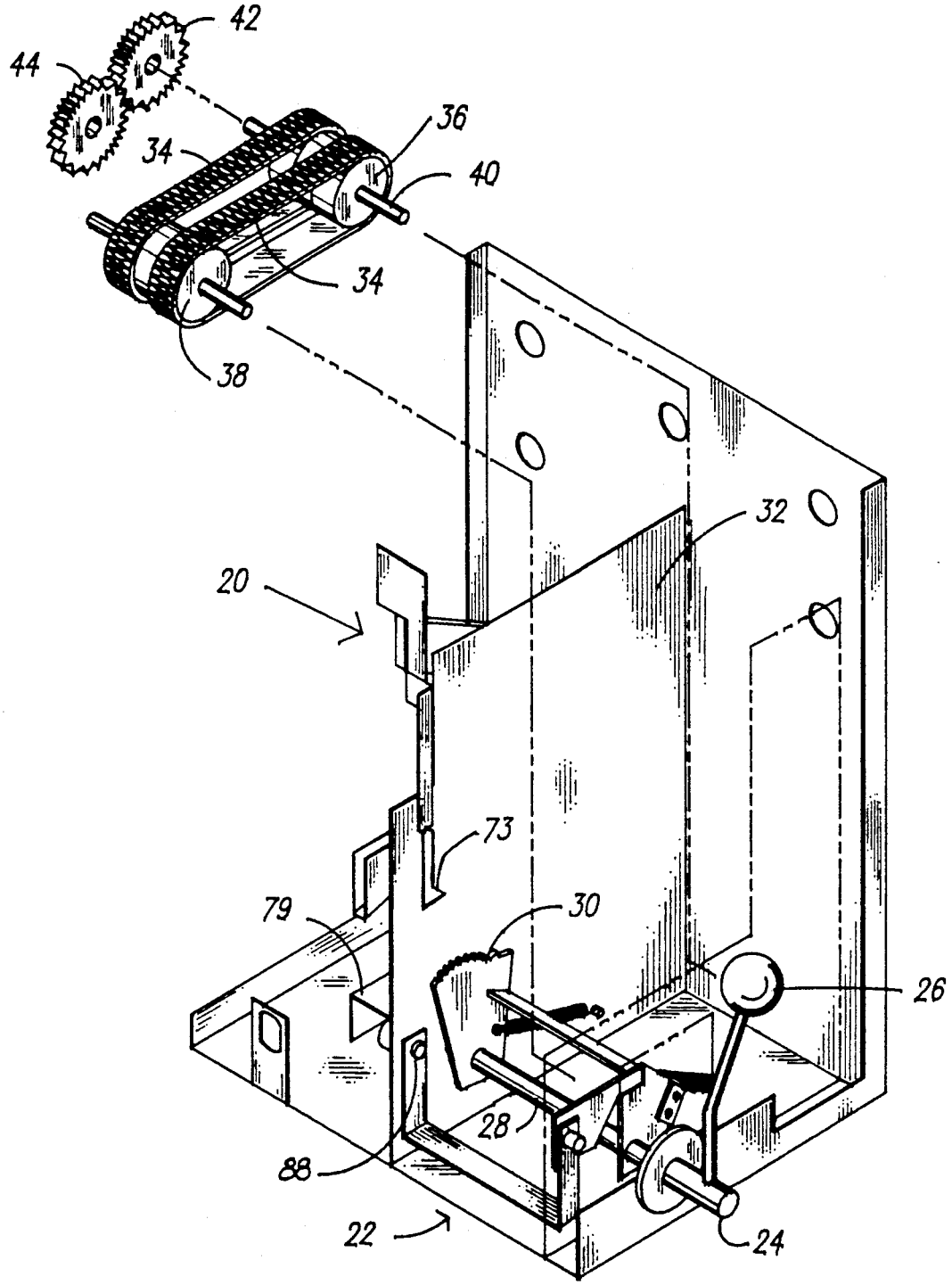
FIG. 3 is an exploded view of the ticket dispensing apparatus.

Throughout the following detailed description, the same reference numerals refer to the same elements in all figures.

The ticket vending machine 10 as shown in FIG. 1 has a front 12, rear 14, right 16 and left 18 panel enclosing a money accepting 20 and ticket dispensing 22 apparatus. Panel 16 has a shaft 24 attached to a lever 26 which penetrates panel 16. A set screw, not shown, attaches the shaft 24 to an inner shaft 28. Shaft 28 turns the toothed plates 30 and 31. The set screw is made of a soft metal so that strong pulling of the lever 26 without insertion of money breaks the set screw and prevents damage to the apparatus.

The ticket dispensing mechanism 22 is separated from the money receiving apparatus 20 by frame 32. The ticket dispensing apparatus 22 has a pair of latex rough surface bands 34 mounted on a pair of drums or roller frames 36 and 38 respectively. The rear roller frame 36 has a shaft 40 that is connected to the drive gear 42 seen in FIG. 7.

Figure 7:
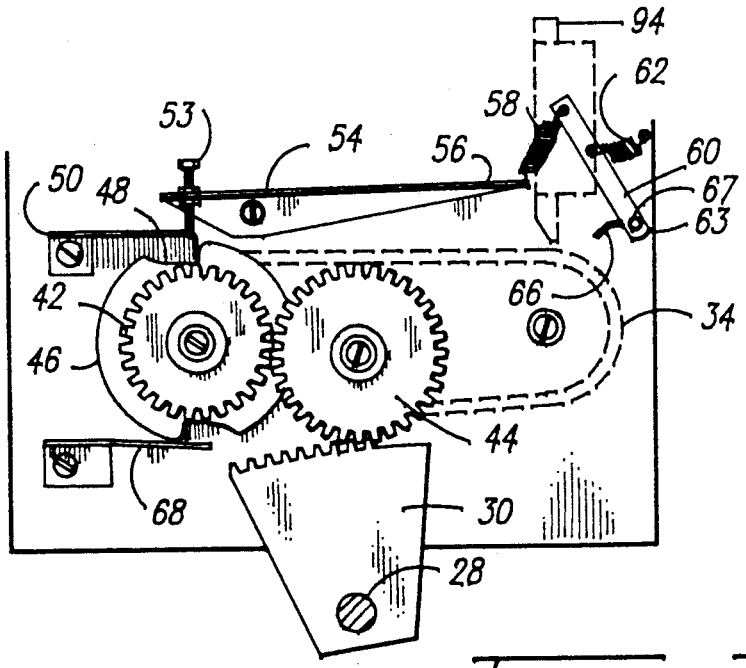
FIG. 7 is a sectional elevation view of the actuating gearing for the ticket dispensing apparatus at the beginning of a cycle.
Figure 8:
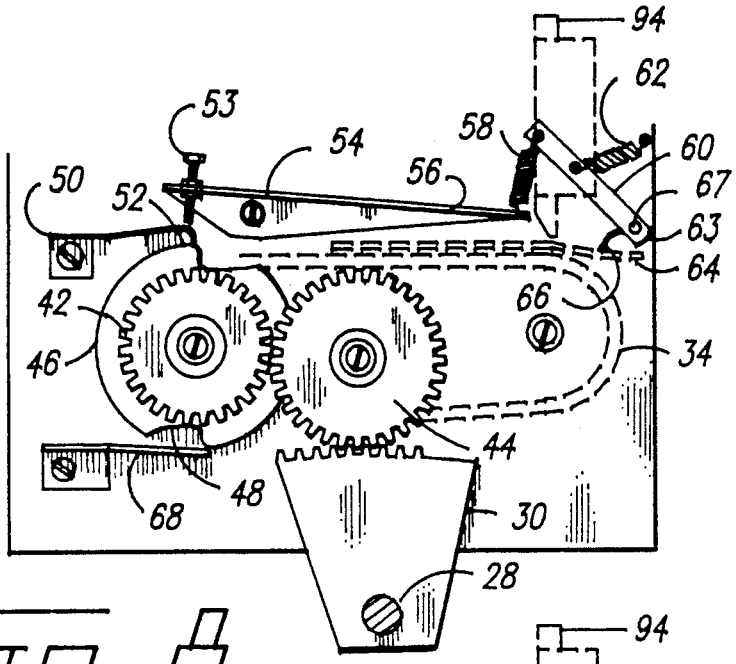
FIG. 8 is a sectional elevation view of the actuating gearing for the ticket dispensing apparatus half way through a cycle.
Figure 9:
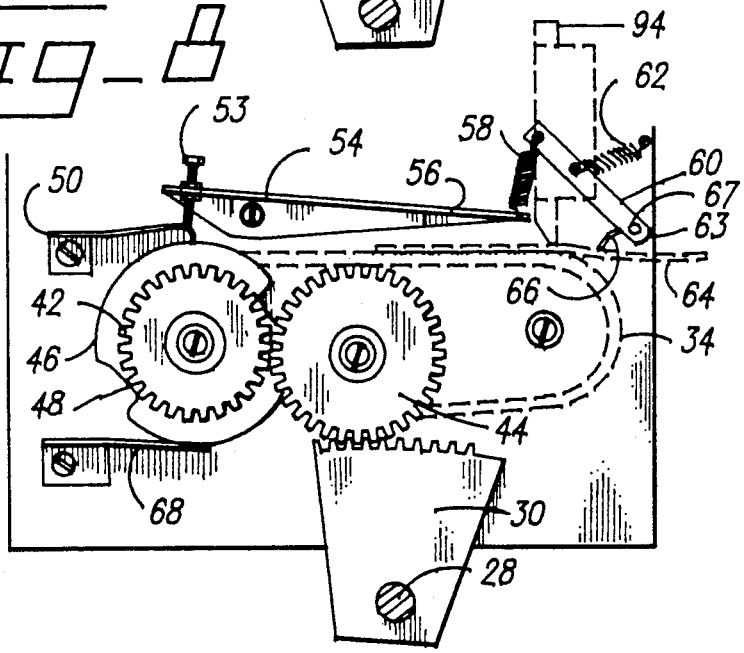
FIG. 9 is a sectional elevation view of the actuating gearing for the ticket dispensing apparatus at the end of a cycle.

A forward pulling motion on lever 26 after the correct money has been inserted causes the toothed gear 30 as seen in FIG. 7 to begin to move forward and engage intermediate gear 44 which in turn moves gear 42. A cam wheel 46 moves in a clock-wise direction with gear 42 as seen in FIGS. 7, 8 and 9. As seen in FIG. 7 a leaf spring 50 engages cam groove 48 to prevent any reverse motion in the gearing. As lever 26 is pulled forward, the leaf spring 50 rides over the high point 52 on the cam 46. This raises the adjustment screw element 53 and depresses the front portion 56 of gate lever 54. Tension is thereby exerted on spring 58. Tension on spring 58 causes spring lever 60 to be depressed and causes spring 62 to be put under tension. The first end 63 of lever 60 is thereby raised. This allows a ticket 64 to move through the adjustment gate 66 as shown in FIG. 8. As seen in FIG. 9, the process continues until a ticket has been fully dispensed. By this time, leaf spring 50 engages another cam groove 48 and completes the cycle by allowing lever 54 to reach a horizontal plane again. A second leaf spring 68 maintains tension on the cam 46.

Figure 4:
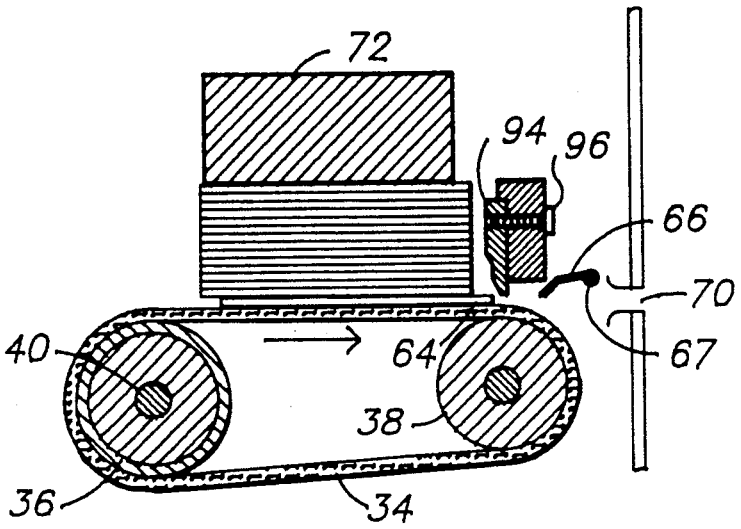
FIG. 4 is a sectional elevation view of the ticket dispensing apparatus beginning its cycle.
Figure 5:
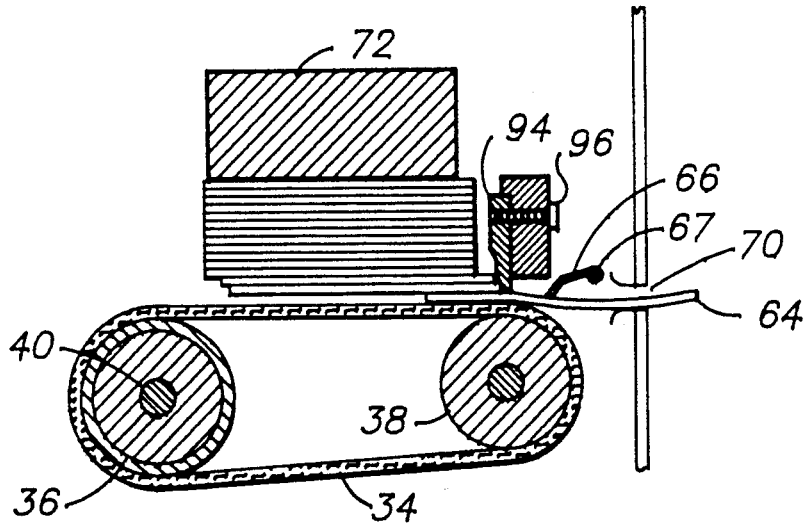
FIG. 5 is a section elevation view of the ticket dispensing apparatus half way through its dispensing cycle.
Figure 6:
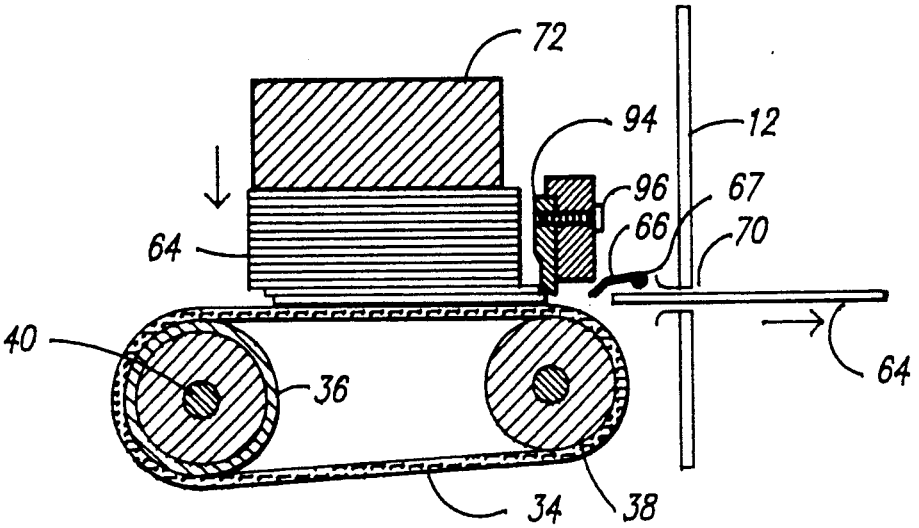
FIG. 6 is a sectional elevation view of the ticket dispensing apparatus at the end of its cycle.

As seen in FIGS. 4, 5 and 6, the rotation of shaft 40 causes drum 36 to rotate and thereby causes the band 34 to move forward. The rough surface of the bands 34 causes the ticket 64 to move forward since gate 66 has been raised as seen in FIG. 8. The ticket 64 bends slightly as it moves through opening 70 in housing panel 12. A second ticket cannot exit because gate 66 has been lowered. Bar 67 supports gate 66 and the end of bar 67 is a pivot point for lever 60. A weight 72 on top of the tickets 64 exerts sufficient pressure on the tickets to enable the bands 34 to move the ticket by frictional forces. When weight 72 descends to shelf 73, it actuates an empty signal in opening 75 in panel 12.

Figure 10:
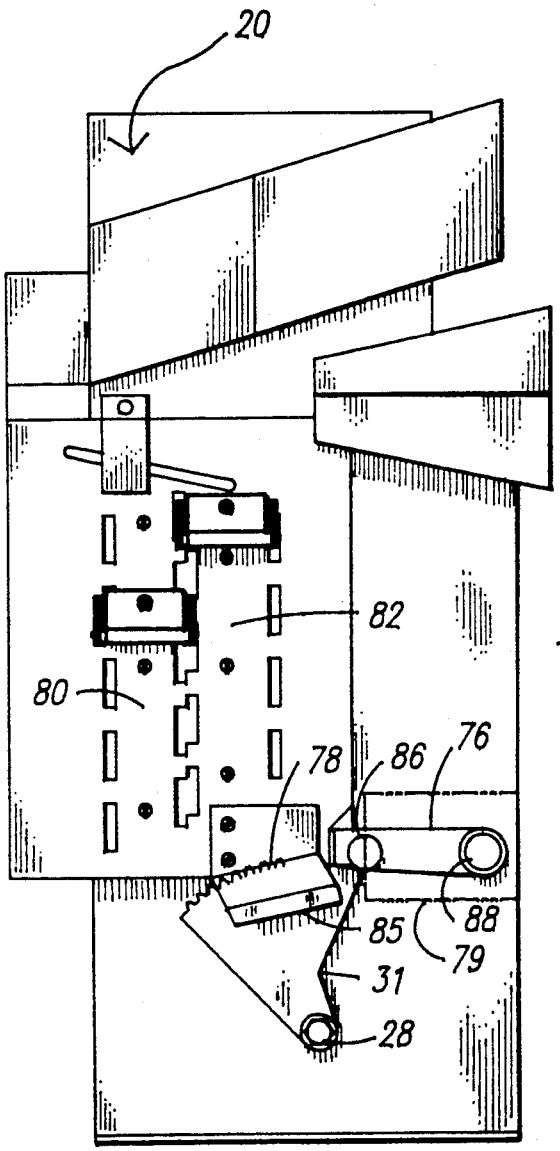
FIG. 10 is a sectional elevation view of the coin actuation mechanism.
Figure 11:
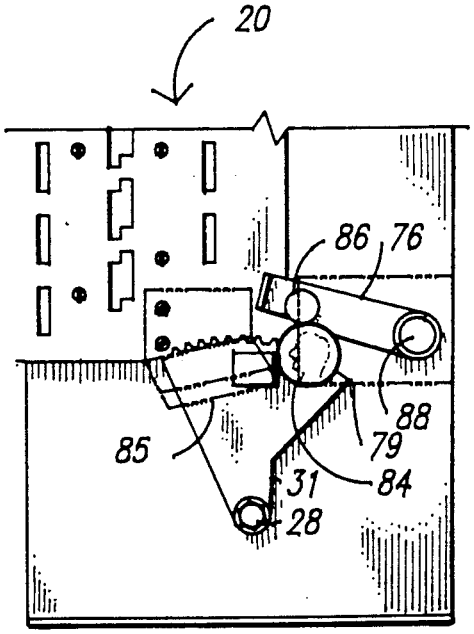
FIG. 11 is a sectional view of the coin actuation mechanism releasing the stop lever.

The money receiving apparatus 20 shown in FIGS. 10 and 11 is suitable for receiving coins. A paper money diode system can be substituted for the coin apparatus. Prior to insertion of a coin in slot 74, a stop lever 76 engages the teeth 78 on the toothed plate 31. Housing 79 encloses the stop lever 76. The mechanism can be preset for the number of coins required so that once coins fill up column 80, they fall into column 82. A coin 84 will exit at slot 85 so as to raise roller 86 which causes the stop lever 76 to rise up and disengage from teeth 78. This allows the toothed plate 31 to move forward in reaction to the lever 26 and the cycle of removing a ticket begins. The stop lever 76 pivots at point 88.

A frame having side panels 90 and 92 enclose the stacked tickets 64. An adjustment gate 94 which controls gate 66 can be changed in height by set screw 96. This permits adjustment for different size tickets 64 moving under gate 66.

The money accepting and ticket dispensing apparatus are preferably made from stainless steel or other high quality metal. The outer housing panels can be a metal or a high strength polymer.

Having thus described the invention, what is claimed and desired to be secured by Letters Patent is:

1. In a ticket vending machine having a housing with front, rear, right and left side, top and bottom panels enclosing a money accepting and ticket dispensing apparatus with a hand lever connected to an outer shaft penetrating one panel of the housing, a first slot in one panel for inserting money and a second slot for dispensing a ticket, the improvement comprising having an inner shaft connected to the outer shaft, the inner shaft connected to a toothed plate for driving an intermediate gear, the intermediate gear driving a drive gear axially connected to a cam wheel, the cam wheel having a low point and a high point for actuating a leaf spring attached to an internal panel, the leaf spring moving upward over the high point of the cam raising a first end of a spring lever to which it is connected, a second end of the spring lever connected to a gate lever by a spring, the second end of the spring lever moving downward to raise one end of the gate lever to allow exit of a ticket from a stack mounted within a ticket dispensing apparatus, a pair of rotating drums mounted below the ticket stack with a band connecting the pair of rotating drums, one drum being driven by a shaft connected to the drive gear so that rotation of the drive gear rotates the drum and moves a ticket outward from the ticket dispensing apparatus upon release of a stop within the money accepting apparatus, the stop being released by insertion of money into the money accepting apparatus.

2. The ticket vending machine according to claim 1 wherein the inner shaft drives the toothed plate and a second toothed plate within the money accepting apparatus, the second toothed plate being capable of moving after a programmed amount of money is inserted into the money accepting apparatus.

3. The ticket vending machine according to claim 2 wherein a coin releases a stop lever to allow the second toothed plate to move.

4. The ticket vending machine according to claim 1 wherein a gap permitting exit of the ticket is adjusted by an adjustment gate controlled by a set screw to provide a device for adjusting to different thickness tickets.

5. The ticket vending machine according to claim 1 wherein a lever actuates a sign in a housing panel to indicate that no tickets are left in the machine, the lever being actuated by a weight mounted over the ticket stack and engaging the lever after the last ticket is dispensed.

6. The ticket vending machine according to claim 1 wherein connecting the pair of rotating drums is a pair of rough surfaced latex bands which frictionally engage a ticket to be dispensed.

7. The ticket vending machine according to claim 1 wherein the outer and inner shafts are connected by a shear pin made of a light weight metal to protect the inner shaft if the hand lever is powerfully pulled without money being deposited into the machine to release a stop.

8. The ticket vending machine according to claim 1 wherein the cam wheel has a pair of low points about 180 degrees apart to permit the drive gear to dispense one ticket after each 180 degree rotation.

9. A ticket vending machine having an outer housing enclosing a money accepting and ticket dispensing apparatus comprising;

a hand operated lever exterior to the outer housing, the lever connected to an outer shaft penetrating the outer housing, the outer shaft connected to an inner shaft, the inner shaft turning a first and second toothed plate inside the outer housing, the first toothed plate engaging an intermediate gear, the intermediate gear engaging a drive gear axially connected to a cam wheel within the ticket dispensing apparatus, the cam wheel actuating a leaf spring, the leaf spring connected to a gate lever for raising and lowering a gate each time the leaf spring passes a high point on the cam to permit exit of a ticket from a stack mounted in the ticket dispensing apparatus under a weight, a pair of rotating drums mounted below the ticket stack with a band connecting the drums, one drum being driven by a shaft connected axially to the drive gear so that rotation of the drive gear rotates the drum and moves a ticket outward over the band, the second toothed plate engaged to a stop lever in the money accepting apparatus, the stop lever pivoting away from engagement with the second toothed plate upon insertion of a prescribed amount of money into the money accepting apparatus and the inner shaft only being capable of turning when the stop lever is disengaged from the second toothed plate.

10. A ticket vending machine according to claim 9 wherein the leaf spring rides on the cam, the leaf spring connected to a first end of a gate lever by an adjustment screw, the leaf spring raising the first end of the gate lever and thereby depressing a second end of the gate lever attached to a spring attached at a first end of a spring lever, the spring lever pivoting on a bar supporting the gate to raise the gate each time the leaf spring passes a high point on the cam.

11. A ticket vending machine according to claim 9 wherein a coin raises the stop lever after falling from a first column of coins to a second column.

12. A ticket vending machine according to claim 9 wherein the cam wheel has two high points and two low points, each high point beginning about 180 degrees from the other high point.

13. A ticket vending machine according to claim 9 wherein an inner panel separates the money accepting apparatus from the ticket dispensing apparatus with the inner shaft penetrating the inner panel to connect the two toothed plates.

14. A ticket vending machine according to claim 9 wherein two adjacent latex bands having a rough surface connect the pair of rotating drums.

15. A ticket vending machine according to claim 9 wherein the outer housing has openings leading to the money accepting and ticket dispensing apparatus.

* * * * *